United States Patent [19]

Pfeifer et al.

[11] 3,948,218

[45] Apr. 6, 1976

[54] ELECTROSTATIC COPIER DEVICE

[75] Inventors: Josef Pfeifer, Unterhaching; Rudolf Eppe, Taufkirchen; Günther Schnall, Eching, all of Germany

[73] Assignee: AGFA-Gevaert, A.G., Leverkusen, Germany

[22] Filed: Nov. 27, 1974

[21] Appl. No.: 527,868

[30] Foreign Application Priority Data

Nov. 30, 1973 Germany ..... 2359872

[52] U.S. Cl. ..... 118/637; 118/312; 118/636; 198/198; 427/20

[51] Int. Cl.[2] ..... G03G 15/08

[58] Field of Search..... 118/637, DIG. 24, 308, 118/312, 324, 636; 427/20; 355/3 DD; 198/193, 198

[56] References Cited

UNITED STATES PATENTS

| | | | |
|---|---|---|---|
| 1,402,251 | 1/1922 | Raymond, Jr. | 198/193 |
| 1,718,150 | 6/1929 | Hurxthal et al. | 198/193 |
| 2,604,068 | 7/1952 | Dolbey | 118/308 |
| 2,977,266 | 3/1961 | Sedgley | 198/198 |
| 3,251,706 | 5/1966 | Walkup | 118/637 |
| 3,613,638 | 10/1971 | Solarek | 118/637 |
| 3,673,600 | 6/1972 | Damouth | 118/637 |
| 3,698,926 | 10/1972 | Furuichi | 118/637 |

*Primary Examiner*—Mervin Stein
*Assistant Examiner*—Douglas Salser
*Attorney, Agent, or Firm*—Michael J. Striker

[57] ABSTRACT

In an electrostatic copier using a particulate developer mix the invention provides a source of the mix, a supply ramp having an inlet end located higher than the source, and a conveyor for conveying the developer mix from the source to the inlet end of the supply ramp. The conveyor is composed of an endless flexible belt trained about at least one driven roller and having one end portion which extends into the source and another end portion which discharges onto the inlet end of the ramp. A plurality of pins is anchored in the belt and projects from a conveying surface thereof so as to entrain the developer mix from the source.

10 Claims, 2 Drawing Figures

ELECTROSTATIC COPIER DEVICE

BACKGROUND OF THE INVENTION

The present invention relates generally to electrostatic copiers, and more particularly to an electrostatic copier having a novel developing device.

It is known to provide electrostatic copiers with developing devices utilizing a developer that is composed of toner particles and carrier particles. In such devices the developer mix as the mixture of toner particles and carrier particles will hereafter be called, is supplied from a source of the mix to the inlet end of a supply ramp, the inlet end being located higher than the source, for so-called "cascade developing", where the mix is discharged onto the supply ramp so that it can slide down on the same.

In devices of this type the quality of the development of the image depends to a large extent upon the satisfactory maintenance of as uniform as possible a flow of the developer mix on the aforementioned ramp. The manner in which the developer mix is conveyed from the source to the ramp varies in the prior art. A particularly common way of doing this is to use bucket chains; however, because of the discontinuous supply of the developer mix, in which each bucket of the chain dumps its batch of mix onto the ramp and no further mix is supplied until the next bucket arrives, a uniform flow of the developer mix down the ramp is very difficult to obtain, and can be assured only if intermediate storage devices, elongated supply chutes or other elements are utilized, which require much space and are expensive. Other approaches to the feeding of the developer mix, such as feed screws and the like, have not led to an economically satisfactory and completely reliable solution either.

SUMMARY OF THE INVENTION

Accordingly, it is a general object of this invention to overcome the disadvantages of the prior art.

More particularly, it is an object of this invention to provide an improved electrostatic copier device having a conveying arrangement for the developer mix which avoids the disadvantages of the prior art.

In keeping with these objects, and with others which will become apparent hereafter, one feature of the invention resides, in an electrostatic copier using a particulate developer mix, in a combination which comprises a source of the developer mix, a supply ramp having an inlet end located higher than the source, and conveying means for conveying the developer mix from the source to the inlet end. According to the invention the conveying means includes an endless flexible belt having one end portion which extends into the source and an other end portion which discharges onto the inlet end. At least one driven roller engages the belt for driving the same, and a plurality of pins is anchored in the belt and projects from a conveying surface thereof so as to entrain developer mix from the source.

The fact that such a belt is highly reliable, and offers the same conveying effect as a plurality of extremely small (e.g. mini) buckets of a bucket chain conveyor, has been quite surprising. It is not entirely understood why a belt of this type is capable of conveying particulate material such as constitutes the developer mix, but it is believed that the conveying action results from the mutual blocking action exerted by the pins anchored in the belt in cooperation with the presence and blocking action of the developer particles themselves. Electrostatic attraction between the particles themselves, and between the particles and the pins of the belt may also be playing a role and increase the blocking action. In any case it has been found that the extremely simple-to-manufacture belt according to the present invention is capable of supplying a very strong and continuous stream of developer mix of such uniformity that the use of any other devices required in the prior art to enforce uniformity of flow, is completely unnecessary. The belt according to the present invention achieves all this while itself requiring only little space and being quite small. Moreover, the belt according to the present invention is capable of assuring the uniformity of flow of developer mix even though the physical characteristics and conditions of the developer mix may vary within a wide range of conditions.

It is advantageous if the belt according to the present invention is a conventional wire-brush belt which is commercially available in the market, because this further reduces the expense of the arrangement.

We have found that a particularly good conveying action is obtained if the free space between mutually adjacent ones of the pins on the belt corresponds approximately to 1.5 times the diameter of the essentially spherical or ball-shaped carrier particles of the developer mix, and if the individual pins on the belt are either curved or angled in the direction of advancement (e.g. the conveying direction) of the belt such a construction assures that the interstices between the pins will become almost completely filled as the pins dip into the body of developer mix at the source, and remain filled until they discharge the developer mix at the inlet end of the supply ramp.

It is advantageous if the pins themselves are of electrically conductive material, and if their tips approach to a distance of less than 3 mm from the copy carrier at least at one location thereof. In such a construction the belt according to the present invention can also assume the function of a developing electrode, which is particularly true if the belt is of electrically insulating material (which is advantageous but not absolutely necessary) and the pins are of electrically conductive material and those portions of the pins which extend to the reverse side of the belt are in electrical contact with an electrode which for purposes of forming a developing electrode of the belt is connected with an appropriate potential, preferably ground potential.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
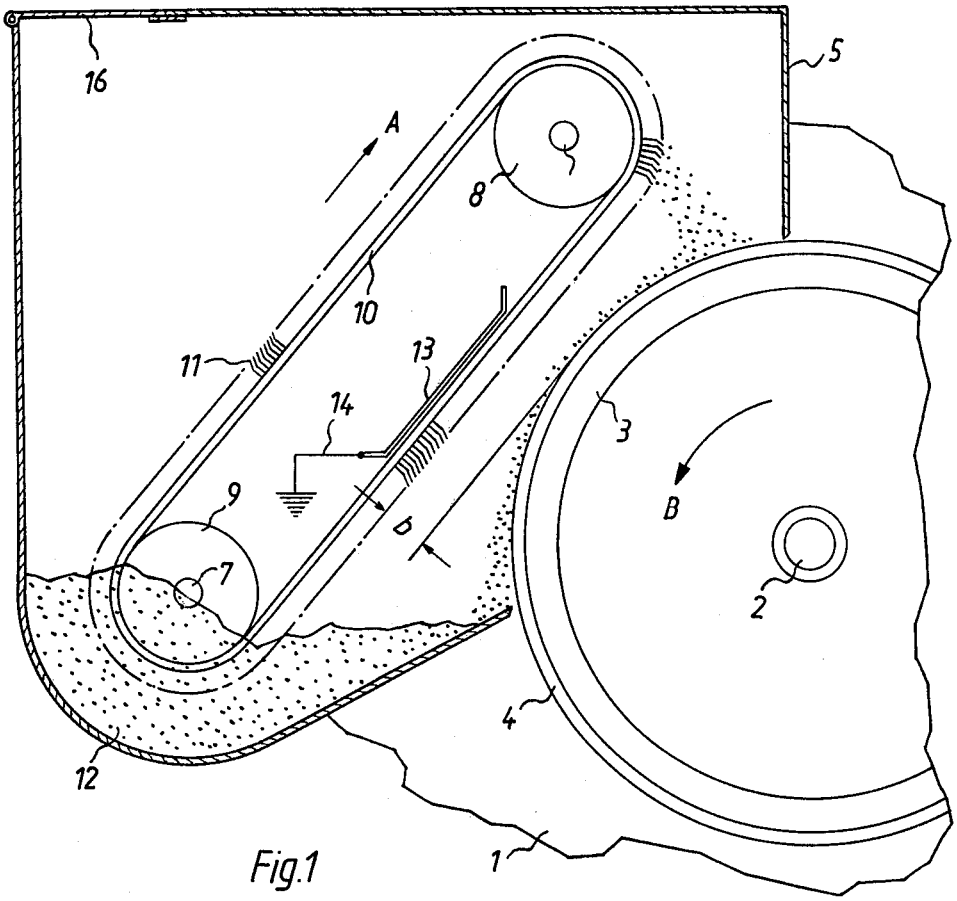
FIG. 1 is a partially diagrammatic section through an embodiment of the present invention.
Figure 2:
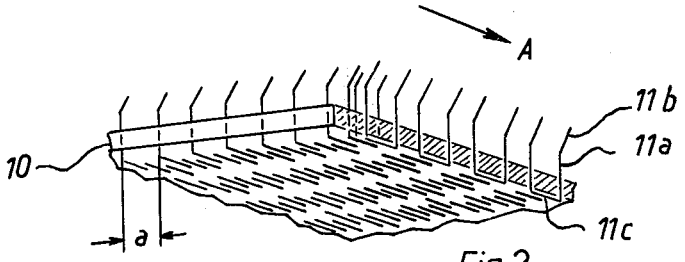
FIG. 2 is a fragmentary detail view, illustrating on an enlarged scale the construction of a belt as used in FIG. 1.

Referring to FIGS. 1 and 2 it will be seen that in FIG. 1 reference numeral 1 identifies a machine frame in which there is journalled the shaft 2 of a copy cylinder 3. The shaft 2 is journalled for rotation and the surface of the cylinder 3 carries a photoconductive selenium layer 4.

Arranged subsequently to the cylinder 3 is the housing 5 of a developing arrangement according to the present invention. Shafts 6 and 7 of rollers 8 and 9 are journalled for rotation in the housing 5, and at least the shaft 6 is driven in rotation, for example by means of a drive motor which is not illustrated because it is known per se. A flexible belt 10 is trained about the rollers 8 and 9 and its outwardly facing conveying surface has a plurality of wire pins 11 projecting from it; these pins are anchored in the belt 10. The belt 10 is driven in the direction of the arrow A by rotation of the shaft 6 and the roll 8. In so doing its lower end dips into a source 12 of particulate developer mix. The reverse side of the belt 10 engages a developer electrode 13 which is connected via a conductor 14 to ground potential. Provided at the upper side of the housing 5 is a door or flap 16 for admitting or replenishing of developer mix particles, that is particles of toner and/or carrier material.

FIG. 2 shows particularly clearly that the pins 11 are constructed as U-shaped hooks which are pushed through the material of the belt 10. The bights 11*c* of the U-shaped hooks are located at the reverse side of the belt 10 and form an electrically conductive connection with the developer electrode 12 that is shown in FIG. 1. The pins themselves constitute the arms of the U-shaped hooks and each have a portion 11*a* that extends through the belt material and a portion 11*b* that is angled forwardly in the direction A through approximately 30°. The spacing *a* of the pins 11 from one another is approximately 1 mm in both coordinate directions. The diameter of the pins is 0.3 mm, so that the free space between the pins is 0.7 mm.

The operation of the arrangement according to the present invention will already be evident from the description that has gone before. However, for a better understanding it will be briefly summarized as follows:

The copy cylinder 3, 4 carries in known manner a latent electrostatic image. It rotates in the direction of the arrow B, and at the same time the belt 10 with the pins 11 is advanced in the direction of the arrow A. Since the lower end of the belt 10 dips into the developer mix source 12, the pins 11 pick up quantities of this particulate mix which become lodged and retained in the spaces between the adjacent pins 11 and thus travel with the belt 10 during the movement of the same in the direction of the arrow A. The developer mix particles are firmly retained and only after a portion of the belt carrying the respective pins between which the particles are lodged has passed over the roller 8, will the spaces empty so that the particles retained in them are dropped onto the copy cylinder 3, 4. The copy cylinder 3, 4 may also be thought of as a supply ramp, or could presumably be preceded by a separate supply ramp. The particles of developer mix flow in a uniform continuous stream over the cylinder 3 and excess returns into the housing 5. During the developing operation the tips of the pins 11, which travel at a distance of less than 3 mm past the surface of the layer 4 on the copy cylinder 3 (the latter is also sometimes called a copy carrier), and the portions 11*c* of the pins which extend to the reverse side of the belt 10 and which are connected with the electrode 13, thus act as a developing electrode.

It will be understood that each of the elements described above, or two or more together, may also find a useful application in other types of constructions differing from the types described above.

While the invention has been illustrated and described as embodied in an electrostatic copier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In an electrostatic copier using a particulate developer mix having particles of a given dimension, a combination comprising a source of said developer mix; a supply ramp having an inlet end located higher than said source; and conveying means for conveying said developer mix from said source to said inlet end, including an endless flexible belt having one end portion which extends into said source and another end portion which discharges onto said inlet end, at least one driven roller engaging said belt for driving the same, and a plurality of pins anchored in said belt and projecting from a conveying surface thereof so as to entrain developer mix from said source, the spacing between adjacent ones of said pins being greater than said dimensions but smaller than a multiple thereof.

2. A combination as defined in claim 1, wherein said pins are angled in the direction of advancement of said belt.

3. A combination as defined in claim 1, wherein said pins are curved in the direction of advancement of said belt.

4. In an electrostatic copier using a particulate developer mix, a combination comprising a source of said developer mix; a supply ramp having an inlet and located higher than said source; and conveying means for conveying said developer mix from said source to said inlet end, including an endless flexible wire brush belt having one end portion which extends into said source and another end portion which discharges onto said inlet end, at least one driven roller engaging said belt for driving the same, and a plurality of wire sections anchored in said belt and projecting from a conveying surface thereof so as to entrain developer mix from said source.

5. In an electrostatic copier using a particulate developer mix having substantially ball-shaped particles, a combination comprising a source of said developer mix; a supply ramp having an inlet end located higher than said source; and conveying means for conveying said developer mix from said source to said inlet end, including an endless flexible belt having one end portion which extends into said source and another end portion which discharges onto said inlet end, at least one driven roller engaging said belt for driving the same, and a plurality of pins anchored in said belt and projecting from a conveying surface thereof so as to entrain developer mix from said source, the spacing between adjacent ones of said pins corresponding to substantially 1.5 times the diameter of said particles.

6. In an electrostatic copier using a particulate developer mix and including a copy carrier, a combination comprising a source of said developer mix; a supply ramp having an inlet end located higher than said source; and conveying means for conveying said developer mix from said source to said inlet end, including an endless flexible belt having one end portion which extends into said source and another end portion which discharges onto said inlet end, at least one driven roller engaging said belt for driving the same, and a plurality of pins anchored in said belt and projecting from a conveying surface thereof so as to entrain developer mix from said source, said pins being of electrically conductive material and having tips which approach said copy carrier to within less than 3 mm.

7. In an electrostatic copier using a particulate developer mix, a combination comprising a source of said developer mix; a supply ramp having an inlet end located higher than said source; and conveying means for conveying said developer mix from said source to said inlet end, including an endless flexible belt having one end portion which extends into said source and another end portion which discharges onto said inlet end, at least one driven roller engaging said belt for driving the same, and a plurality of pins anchored in said belt and projecting from a conveying surface thereof so as to entrain developer mix from said source, said belt also having a reverse surface opposite said conveying surface and said pins being of electrically conductive material and having portions located at said reverse surface.

8. A combination as defined in claim 7, wherein said belt is of electrically insulating material.

9. A combination as defined in claim 7, wherein said portions of said pins are connected with an electrode that is connected to a potential requisite to constitute a developer electrode.

10. A combination as defined in claim 9, wherein said electrode is connected to ground potential.

* * * * *